US006626182B2

(12) United States Patent
Miura

(10) Patent No.: US 6,626,182 B2
(45) Date of Patent: Sep. 30, 2003

(54) CIGARETTE HOLDER

(75) Inventor: Noriyoshi Miura, Tokyo (JP)

(73) Assignee: Eduard Kriheli, Roslyn Heights, NY (US)

( * ) Notice: Subject to any disclaimer, the term of this patent is extended or adjusted under 35 U.S.C. 154(b) by 0 days.

(21) Appl. No.: 09/854,249

(22) Filed: May 11, 2001

(65) Prior Publication Data

US 2002/0166562 A1 Nov. 14, 2002

(51) Int. Cl.[7] ..... A24D 1/04

(52) U.S. Cl. ..... 131/201; 131/210; 131/211; 131/216; 131/346

(58) Field of Search ..... 131/187, 190, 131/194, 195, 199, 189, 201, 210, 346, 211, 216

(56) References Cited

U.S. PATENT DOCUMENTS

| | | | | | |
|---|---|---|---|---|---|
| 2,385,651 | A | * | 9/1945 | Ricketts | 131/182 |
| 2,543,168 | A | * | 2/1951 | Herriot | 131/182 |
| 3,515,150 | A | * | 6/1970 | Helman | 131/207 |
| 3,601,133 | A | * | 8/1971 | Eck et al. | 131/210 |
| 3,636,960 | A | * | 1/1972 | Blount et al. | 131/187 |
| 4,202,358 | A | * | 5/1980 | Drapaniotis | 131/187 |
| 4,344,444 | A | * | 8/1982 | Miura | 131/201 |
| 4,446,877 | A | * | 5/1984 | Aikman | 131/198.1 |
| 4,461,308 | A | * | 7/1984 | Le Cover | 131/198.1 |
| 4,481,955 | A | * | 11/1984 | Terasaki | 131/198.1 |
| 4,841,994 | A | * | 6/1989 | Lugli | 131/210 |

FOREIGN PATENT DOCUMENTS

| | | | | |
|---|---|---|---|---|
| DE | 3528866 A1 | * | 2/1987 | A24F/13/06 |
| JP | 09154560 | * | 6/1997 | A24F/13/06 |

* cited by examiner

*Primary Examiner*—Steven P. Griffin
*Assistant Examiner*—Carlos Lopez
(74) *Attorney, Agent, or Firm*—Notaro & Michalos P.C.

(57) ABSTRACT

A cigarette holder for extracting tar has first tar extractor with a stick and a first disc with apertures. A second tar extractor has a cylinder fitted to the stick and a second disc provided on one end of the cylinder and fitted in a flue of transparent resin. Smoke collision portions in the flue face the apertures. Smoke is compressed and accelerated when it passes through the apertures and expands again to collide with the smoke collision portions. It then collides with the second disc. Then the smoke is compressed and accelerated when it passes through the outer circumference of the second disc and the flue. Tar is extracted at each stage and the smoke is cooled by the second tar extractor before it reaches a mouth piece of the holder.

4 Claims, 6 Drawing Sheets

CIGARETTE HOLDER

BACKGROUND OF THE INVENTION

1. Field of the Invention

The present invention relates to a small-sized cigarette holder commonly called a nicotine-removing pipe.

2. Description of Related Art

Conventionally, such a small-sized cigarette holder as shown in Japanese Utility Model Laid-open No. Hei 1-39200 is generally known, wherein a cigarette insertion opening and a flue with a diameter smaller than that of the cigarette insertion opening are provided inside a pipe body made of a transparent material to communicate with each other in an axial direction, a tar extractor composed of a stick portion and a disc portion having a plurality of small apertures is fitted between the flue and the cigarette insertion opening, and the small apertures are disposed to face an inner wall of the flue with a slight space provided therebetween, and wherein the disc portion, as a first disc portion, is formed integrally with the stick portion, the first disc portion is fitted to a bottom portion of the cigarette insertion opening with the small apertures, which are formed in the first disc portion, positioned in the center part thereof, a second disc portion made of a copper plate with a diameter smaller than that of the first disc portion is fitted to the stick portion to face the small apertures of the first disc portion with a slight space provided therebetween, and the second disc portion is accommodated inside the flue.

The cigarette holder itself as described above, which is conventionally known in general, has the advantage that the amount of the extracted tar in the second disc portion is checked from outside and can extract tar from a cigarette sufficiently. However, as harmful effects given by cigarettes, especially tar, to the health are made clear, it becomes necessary to further enhance the ability of removing tar.

Furthermore, in a first tar extractor of the cigarette holder, which is conventionally known in general, since the first disc portion thereof is only pressure-fitted lightly to a first disc portion fitting hole provided adjacent to the cigarette insertion opening, the first tar extractor sometimes gets out of its right fitting position or comes off the cigarette insertion opening during the process of transportation or while it is carried.

A first object of the present invention is to provide a cigarette holder having a further enhanced ability of removing tar compared with that of a conventional one.

Another object of the present invention is to provide a cigarette holder which is devised so that a first tar extractor does not come off its fitting hole.

SUMMARY OF THE INVENTION

In order to achieve the above-mentioned objects, the present invention comprises: a pipe body formed of a transparent material and having a cigarette insertion opening and a flue extending to a mouth section, which are provided to communicate with each other in an axial direction; a first tar extractor composed of a stick portion and a first disc portion with a plurality of small apertures provided therein, and fitted between the cigarette insertion opening and the flue; smoke collision portions provided in the flue to face the small apertures with a slight space provided therebetween; and a second tar extractor composed of a cylinder portion, which is made of metal, and a second disc portion, the cylinder portion being fitted to the stick portion with a slight space provided between an outer circumference of the second disc portion and the flue.

Furthermore, the present invention comprises: a pipe body formed of a transparent material and having a cigarette insertion opening and a flue extending to a mouth section, which are provided to communicate with each other in an axial direction; a first tar extractor composed of a stick portion and a first disc portion with a plurality of small apertures provided therein, and fitted between the cigarette insertion opening and the flue; smoke collision portions provided in the flue to face the small apertures with a slight space provided therebetween; and a second tar extractor composed of a cylinder portion, which is made of metal, and a second disc portion, the cylinder portion being fitted to the stick portion with a slight space provided between an outer circumference of the second disc portion and the flue, wherein a projection for preventing the first disc portion from coming off is provided in a section of the cigarette insertion opening where the first disc portion of the first tar extractor is provided.

In the present invention according to the above embodiments, the small apertures provided in the first disc portion may have smoke compression portions in funnel shapes with their diameters becoming smaller from the side where smoke is sucked in, and the second disc portion of the second tar extractor may have an outer circumference inclined toward the stick portion side from the center part thereof.

According to the present invention, a projection for preventing the first disc portion from coming off is provided in a section of the cigarette insertion opening where the first disc portion of the first tar extractor is provided.

DETAILED DESCRIPTION OF THE PREFERRED EMBODIMENT(S)

Figure 1:
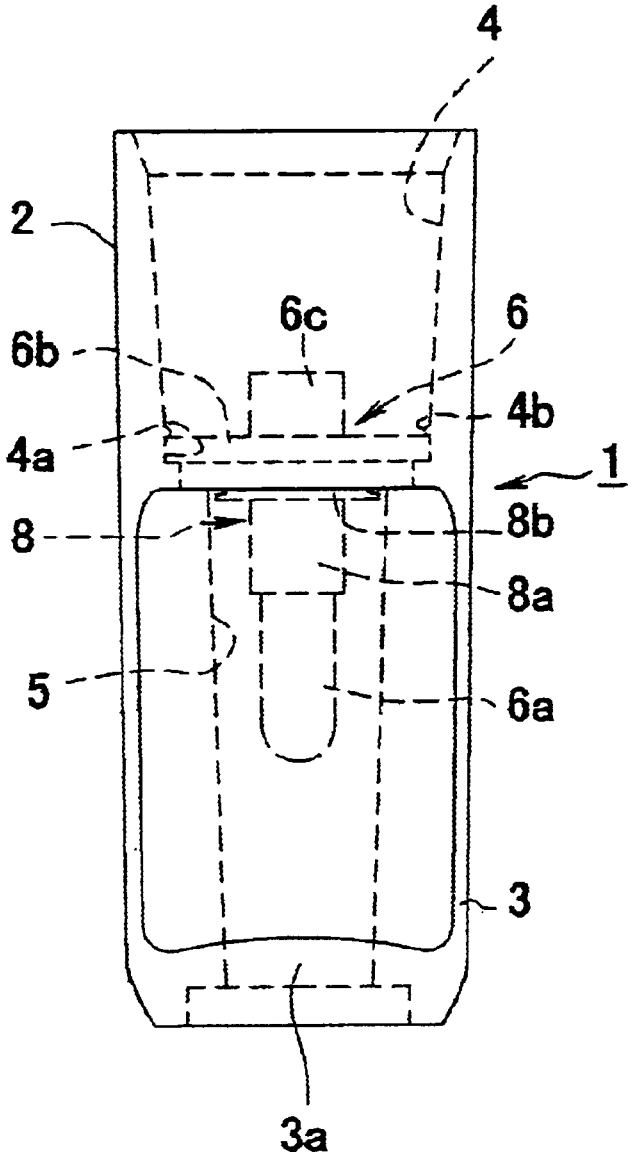
FIG. 1 is a front sectional view of a cigarette holder according to the present invention.
Figure 2:
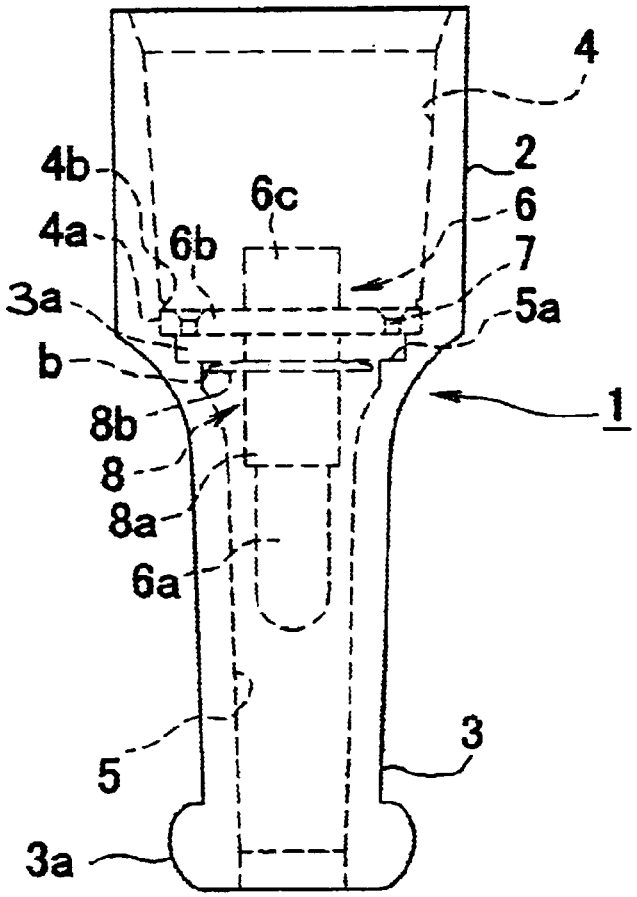
FIG. 2 is a side sectional view of the cigarette holder according to the present invention.
Figure 3:
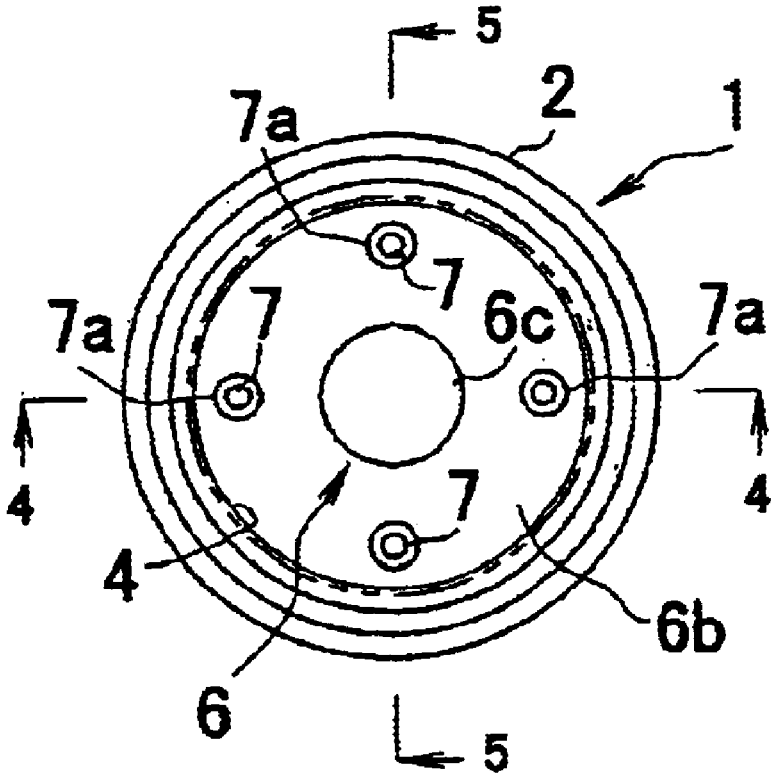
FIG. 3 is a plan view of the cigarette holder according to the present invention.

According to the drawings, a reference numeral 1 in FIG. 1 to FIG. 6 designates a holder body formed of transparent synthetic resin and composed of a cigarette insertion section 2 in a cylindrical shape and a mouth section 3 in a substantially flat shape provided adjacent to the cigarette insertion section 2 and having a stepped portion 3*a* on a mouth side thereof. This holder body 1 has a length of approximately 25 mm, and in the cigarette insertion section 2, a cigarette insertion opening 4 with a large diameter and flue 5, which is provided adjacent to the cigarette insertion opening 4 in a coaxial direction, having a diameter smaller than that of the cigarette insertion opening 4 in a coaxial direction, having a diameter smaller than that of the cigarette insertion pending 4 and having a trumpet-shaped cross section extending in an axial direction when seen from the front, are provided respectively to communicate with each other and pass through the holder body 1 in an axial direction.

A reference numeral 6 designates a first tar extractor. The first tar extractor 6 is composed of a stick portion 6*a*, which is also made of synthetic resin colored with, for example, red, orange, yellow, and so on, and a first disc portion 6*b* in a disc shape, which is provided on the upper face of the stick portion 6*a*, integrally formed with each other and having four small apertures 7. The respective small apertures 7 are disposed in the vicinity of a circumference of the first disc portion 6*b*, and in the small apertures 7, smoke compression portions 7*a* in tapered shapes are provided with their diameters becoming smaller from a smoke sucking-in side toward a smoke sucking-out side to give funnel appearances as a whole, and a boss portion 6*c* is provided opposite to the stick portion 6*a*. In a first disc portion fitting hole 4*a*, which is provided adjacent to the cigarette insertion opening 4, for allowing the first disc portion 6*b* of the first tar extractor 6 to fit therein, a projection 4*b* is provided to prevent the first disc portion 6*b* of the first tar extractor 6, which is fitted therein, from coming or getting out of its fitting position after it is inserted therein.

Smoke collision portions 5*a* are provided in positions in the flue 5 opposite to the respective small apertures 7 with a slight space provided therebetween.

A reference numeral 8 designates a second tar extractor made of metal, for example, copper, brass, stainless steel and so on, and it is composed of a cylinder portion 8*a* and a second disc portion 8*b*, which is provided on one end of the cylinder portion 8*a*, integrally formed with each other, wherein the cylinder portion 8*a* is fitted to the stick portion 6*a* of the first tar extractor 6 and an outer circumference of the second disc portion 8*b* is inclined toward the cylinder portion 8*a* side so that smoke flows smoothly from the flue 5 to the mouth section 3. Between the second disc portion 8*b* and the flue 5, a slight space b is provided, and the fitting position of the cylinder portion 8*a* relative to the stick portion 6*a* is determined by the stepped portion 6*d* provided in the stick portion 6*a* to substantially equal in height to the fitting position of the smoke collision 5*a*. The cylinder portion 8*a* stabilizes the fitting position to the stick portion 6*a* and secures the second disc portion 8*b* to the fitted in the right position without inclining.

Figure 4:
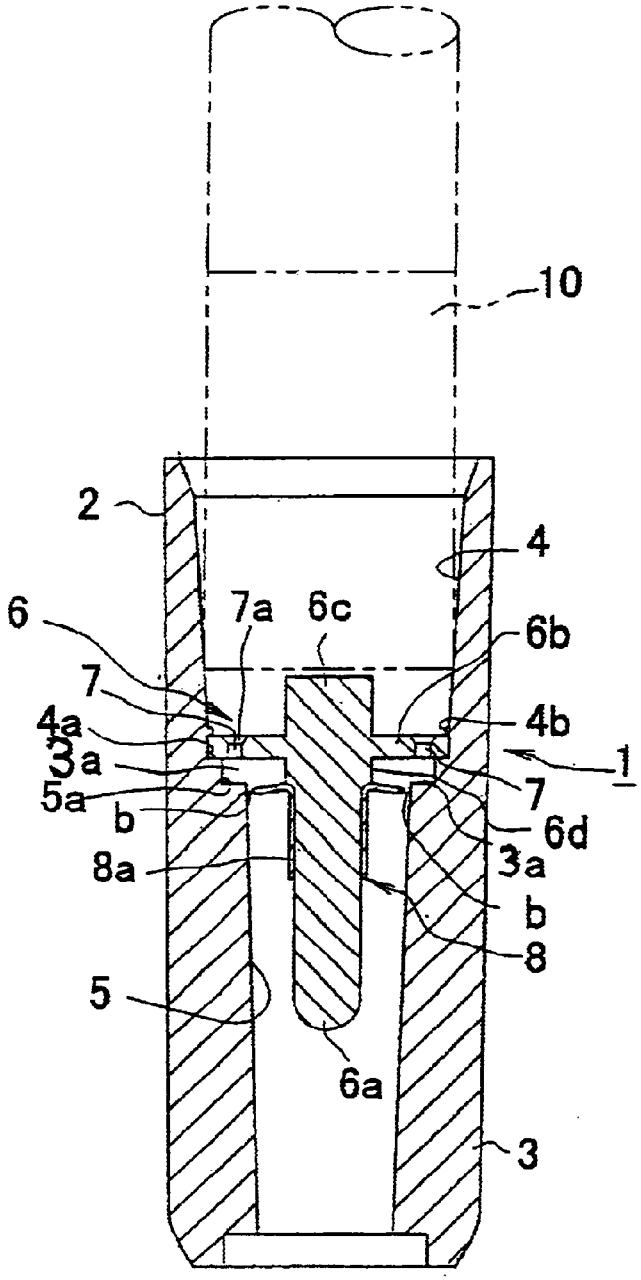
FIG. 4 is a sectional view taken along the 4—4 line in FIG. 3.
Figure 5:
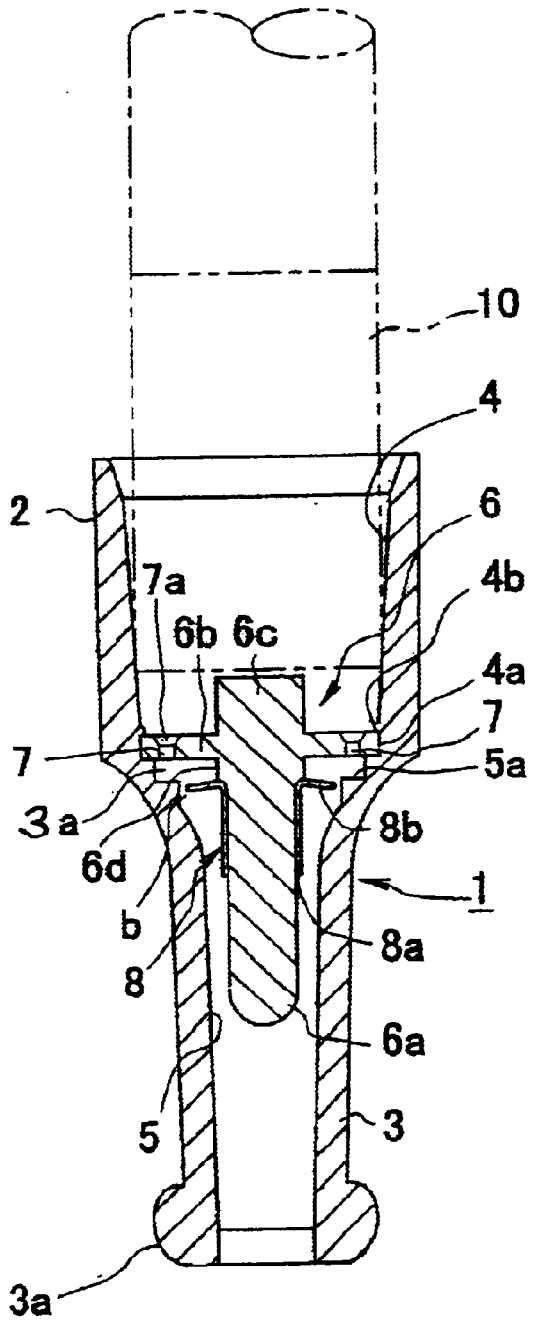
FIG. 5 is a sectional view taken along 5—5 line in FIG. 3.
Figure 6:
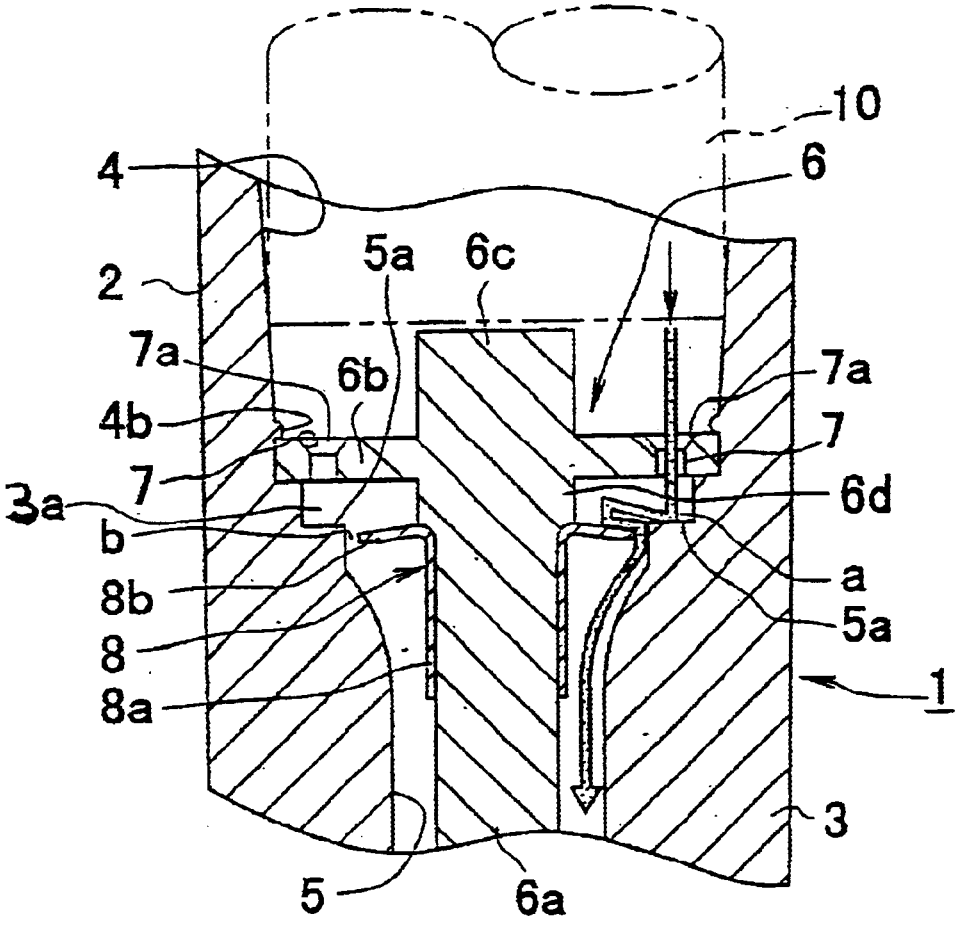
FIG. 6 is an explanatory view explaining the function of the cigarette holder according to the present invention.

Therefore, as shown in FIG 4. and FIG. 5, when one end of a cigarette 10 is inserted into the cigarette insertion opening 4, the cigarette 10 is pressure-inserted until it contacts the boss portion 6*c* to be held in the cigarette insertion section 2. Next, when it is lit to be smoked, cigarette smoke, as especially shown in FIG. 6, is sucked into the flue 5 via the small apertures 7 provided in the first disc portion 6*b*, compressed and accelerated when passing through the small apertures 7, and again expanded to collide with the smoke collision portions 5 and the second disc portion 8*b* so that a kind of tar is extracted to the smoke collision portion 5*a* and the second disc portion 8*b* by a so-called collision absorbing method. The smoke compression portions 7*a* provided in the respective small apertures 7 smooth the cigarettes smoke to sucking respective shall apertures 7, and have a function for compressing and accelerating the cigarette smoke passing more through the respective small apertures 7 after it is sucked in. The smoke colliding with the smoke collision portions 5*a* further collides with the second disc portion 8*b* of the second tar extractor 8, is compressed again when passing through the space b between the outer circumference of the second disc portion 8*b*, the flue 5, and the stick portion 6*a* is expanded again to collide with the inner wall of the flue with its tar extracted to the second disc portion 8*b* and the inner wall of the flue 5, is cooled by second tar extractor 8 made of copper, and sucked in from the mouth section 3 into a smokers mouth, thereby easily preventing his mouth, especially a tongue, from being lightly burnt by the heated smoke reaching it. Furthermore, the second disc portion 6 of the second tar extractor is inclined toward the stick portion 6*a* side of the first tar extractor, so that smoke flows smoothly from the smoke collision portion 5*a* to the month section 3 via the space b. The amount of the extracted tar can be checked from outside through a transparent wall of the holder body 1. The tar contaminates the inside of the flue 5 to flow out to an exit of the mouth section 3 after 5 to 10 cigarettes are smoked. In this state, the holder body 1 is no longer usable to be discarded. Of course, the first tar extractor 6 can be taken out from the cigarette insertion opening 4 together with the second tar extractor 8 to be cleaned for repeated use.

What is claimed is:

1. A cigarette holder comprising:

a holder body (1) of a transparent material, the holder body having a cigarette insertion opening (4) with a first disk portion fitting hole (4*a*), a flue (5) extending to a mouth section (3) or the body, the cigarette insertion opening communicating with the flue and the first disk portion fitting hole (4*a*) being adjacent the flue;

a first tar extractor (6) comprising an axially extending stick portion (6*a*) extending into the flue, and a first disk portion (6*b*) with a plurality of a spaced apertures (7) therein, the first disk portion being seated in the first disk portion fitting hole (4*a*) with the plurality of spaced apertures establishing communication between the cigarette insertion opening and the flue;

at least one smoke collision portion (5*a*) in the flue and closely spaced from and facing the plurality of spaced apertures (7) for receiving smoke from a cigarette inserted in the cigarette insertion opening; and a second tar extractor (8) made of metal and comprising a cylinder portion (8*a*) closely engaged around and supported by the stick portion (6*a*) of the first tar extractor, the second tar extractor including a second disk portion (8*b*) extending outwardly from an end of said cylinder portion which is adjacent the smoke collision portion (5*a*) and extending outwardly with respect to the stick portion (6*a*) with a slight spacing between an outer circumference of the second disk portion and the flue, for collision of smoke from a cigarette engaged in the cigarette insertion opening.

2. A cigarette holder according to claim 1, wherein each of the plurality of small apertures includes a funnel-shaped compression portion (7*a*) which decreases in size from the cigarette Insertion opening toward the flue.

3. A cigarette holder according to claim 2, including a projection (4*b*) on the holder body extending into the cigarette insertion opening (4) and over the first disk portion (6*b*) of the first tar extractor for retaining the first tar extractor in the holder body.

4. A cigarette holder according to claim 3, wherein the first tar extractor is made of colored synthetic material to be visible in the transparent material holder body.

* * * * *